United States Patent [19]

Shimizu et al.

[11] Patent Number: 4,541,109

[45] Date of Patent: Sep. 10, 1985

[54] PILOT SIGNAL DETECTING CIRCUIT FOR AM STEREO SIGNALS

[75] Inventors: Yoshio Shimizu, Yokohama; Satoshi Yokoya, Chofu, both of Japan

[73] Assignee: Sony Corporation, Tokyo, Japan

[21] Appl. No.: 573,475

[22] Filed: Jan. 24, 1984

[30] Foreign Application Priority Data

Jan. 31, 1983 [JP] Japan ..... 58-14176

[51] Int. Cl.[3] ..... H04H 5/00

[52] U.S. Cl. ..... 381/15

[58] Field of Search ..... 381/2, 15, 16

[56] References Cited

U.S. PATENT DOCUMENTS 4,426,728 1/1984 Kahn ..... 381/15

*Primary Examiner*—Forester W. Isen

*Attorney, Agent, or Firm*—Lewis H. Eslinger; Alvin Sinderbrand

[57] ABSTRACT

A pilot signal detecting circuit for use in an AM stereo receiver capable of receiving and demodulating AM stereo signals broadcast according to any of several different AM stereo modulation methods, in which the particular method employed in broadcasting the AM stereo signals is determined by detecting the individual pilot signal and providing an indication of the particular method employed in modulating the broadcast AM stereo signal. Replicas of each of the different pilot signal frequencies in each of the different AM stereo modulation systems are generated and a signal containing the pilot signal is extracted from the demodulated received AM stereo signal. The replicas are compared with the extracted pilot signal to determine the identity of the AM stereo modulation system employed in the received AM stereo signal. A phase-locked-loop is employed to extract the pilot signal from the received signal and a synchronous detector and envelope detector are employed to demodulate the left and right channel stereo signals from the received AM stereo signal. Comparison of the replica and the received pilot signal is performed in identical phase detectors which receive a corresponding replica of the pilot signal produced by another phase-locked-loop and a frequency divider.

19 Claims, 3 Drawing Figures

VCO
80
Low Pass Filter
70
90
Counter
b1
b2
b3
b4
C1
C2
C3
C4
60
26
27
36
37
46
47
56
57
58
28
38
48
20a
20b
20c
20d
30a
30b
30c
30d
40a
40b
40c
40d
50a
50b
50c
50d
20
30
40
50
φ Detector
φ Detector
φ Detector
φ Detector

PILOT SIGNAL DETECTING CIRCUIT FOR AM STEREO SIGNALS

BACKGROUND OF THE INVENTION

1. Field of the Invention

The present invention relates in general to a circuit for detecting a pilot signal contained within a number of transmitted signals and, more specifically, is directed to a circuit for detecting a pilot signal to identify which one of several different AM stereo transmitting systems is being received.

2. Description of the Prior Art

Commercial broadcast of amplitude-modulated (AM) stereo signals have only recently been made available to the public. While such AM stereo broadcasts are desirable and have been eagerly awaited by the public, nevertheless, no one particular system has been designated by the Federal Communications Commission as the standard and at present there are five different stereo systems vying for supremacy. The five different modulation systems used in transmitting AM stereo signals are: amplitude modulation-phase modulation (AM−PM), in which a carrier wave is amplitude-modulated (AM) by a sum signal (L+R) of a stereo left channel signal (L) and right channel signal (R) and the carrier wave is then phase modulated (PM) by a difference signal (L−R) from the same left and right stereo channels; amplitude modulation-frequency modulation (AM−FM), in which a carrier wave is amplitude modulated by the sum signal (L+R) and the carrier is also frequency-modulated by the difference signal (L−R); compatible-quadrature modulation (C−QUAM), in which a phase modulated signal, provided by balanced-modulating and adding (orthogonally modulating) two carrier waves of the same frequency but with a mutual phase difference of 90°, by the left channel signal (L) and the right channel signal (R) is amplitude-modulated by the sum signal (L+R); variable angle compatible phase multiplex (VCPM), which is an orthogonal modulation system but in which the phase-angle difference is controlled in response to the magnitude of the difference signal (L−R); and independent side band (ISB), in which by means of a 90° phase-shifting circuit the carrier wave is amplitude-modulated by the sum signal (L+R) and is phase-modulated by the difference signal (L−R).

All of these five different AM stereo broadcasting systems are in use today and, thus, AM stereo receivers have been proposed that are capable of receiving and decoding or demodulating signals from all of these various AM stereo systems. Such receivers then must have the appropriate circuit construction that is then operably changed in response to the specific AM stereo signals being received at that time. Such change can be determined, and in fact controlled, by a pilot signal contained within the actual AM stereo signals that have been transmitted. Thus, it is necessary to provide a receiver having a circuit to detect a pilot signal that can be transmitted relative to any of the five different AM stereo signal formats.

One system that has been proposed to detect such different pilot signals employs a separate low-pass filter or bandpass filter for each of the various AM stereo broadcast systems, thereby detecting the pilot signals in an analog fashion. However, in order to provide such analog filter circuits capable of detecting all of these various pilot signals the circuit arrangement therefor becomes unduly complicated and complex and, moreover, the performance of such filter circuits is questionable and uncertain due to variations in the shape of the filter transfer characteristic, as well as the actual filtering capabilities which are a function of the manufacturing techniques employed in arranging the specific circuit elements in the filter circuit. Also proposed is a system for extracting the respective pilot signals that employs a separate phase-lock loop and attendant oscillator for each of the various different AM stereo broadcast systems. Further, it is possible in AM broadcasting that a certain phase modulated component, caused by less than accurate transmission at the AM broadcast station, can accompany the AM signals being broadcast, and this causes a misoperation or apparent malfunction at the receiver. Additionally, the circuits to detect the pilot signals are critical to system operation and noise and the like that are mixed with the transmitted signal around the frequency band of the pilot signal will result in faulty detection of such pilot signals and misoperation of the receiver.

OBJECTS AND SUMMARY OF THE INVENTION

Accordingly, it is an object of the present invention to provide an improved pilot signal detecting circuit for receiving AM stereo signals that overcomes the drawbacks inherent in the prior art.

It is another object of the present invention to provide a pilot signal detecting circuit for receiving AM stereo signals, in which the construction and circuit arrangement is simpler than previously known yet which can detect with great certainty the pilot signals that are present in any one of several different AM stereo broadcast systems.

According to one aspect of the present invention, the pilot signal detecting circuit for detecting the pilot signals in AM stereo broadcast signals of any of several different kinds includes an AM stereo demodulator circuit that demodulates AM stereo signals, regardless of which kind, and a system to extract from the demodulated AM stereo signals the signal containing the pilot signal. A plurality of pilot reference signals are generated which have been previously determined to correspond to respective pilot signals of the different AM stereo systems. A detecting circuit is then provided that determines whether or not the outputs from the extracting circuitry and those that are generated locally are coincident with each other and thus the appropriate pilot signal is extracted from the AM stereo signal.

Other objects, features, and advantages of the present invention will become apparent from the following description taken in conjunction with the accompanying drawings, in which like references designate the same elements or parts.

DESCRIPTION OF PREFERRED EMBODIMENTS

The present invention is intended for use with an AM stereo receiver that contains the appropriate circuitry to receive and decode AM stereo signals, which were broadcast using any one of the various different modulation systems for example, AM−PM, C−QUAM, VCPM, and ISB. Such universality or compatibility can be provided by the present invention following the realization that, although each of the different systems has a quite different theoretical bases, there are certain common points which are present in each of the systems. Such common points which permit the present invention to provide a single system compatible with all of the various AM stereo broadcasting formats are as follows:

(1) Because the carrier wave is modulated by a sum signal (L+R) that has no distortion, it is possible to detect the envelope thereof using an envelope detector having the same sum signal (L+R).

(2) Because the envelope or border of the output signal sideband in the middle-band region is compatible with that of a monaural system, the phase deviation in the middle band region is always less than one radian.

(3) As a result of the fixed phase deviation in (2) above, the subchannels made up of the difference signal (L−R) in all of the various systems can be demodulated using the orthogonal synchronizing detection.

The pilot signals in each of the above four different stereo systems can be tabulated as set forth in the following table. It should be noted that each of these pilot signals is used to frequency modulate the carrier wave and is then superimposed upon the stereo signal.

| | AM-PM | ISB | C-QUAM | VCPM |
|---|---|---|---|---|
| frequency (Hz) | 5 | 15 | 25 | 55~96 |
| level (%) | 300~360 | 10 | 3~5 | 7.5 |

Figure 1:
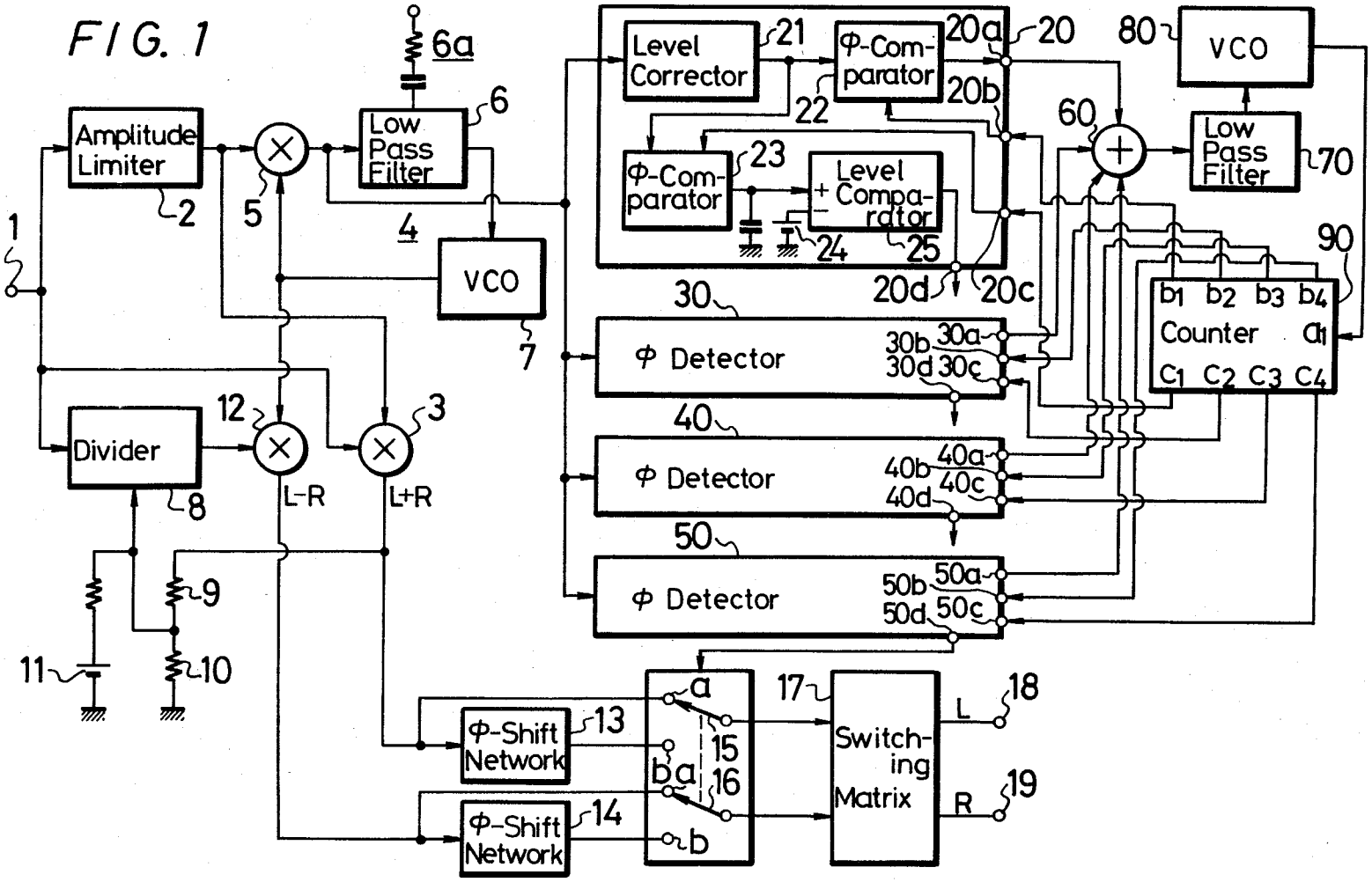
FIG. 1 is a schematic block diagram showing a pilot signal detecting circuit for detecting the pilot signal in AM stereo signals broadcast by one of several different systems, according to the present invention.

In the embodiment of FIG. 1, which is intended for use with a AM stereo receiver capable of receiving all of the several different kinds of AM stereo signals, the intermediate frequency (IF) signal, as provided from the intermediate frequency stage (not shown), is fed in through input terminal 1 to amplitude limiter 2, which limits the amplitude of the IF signal to a substantially constant amplitude. Such amplitude limited IF signal is fed to balanced mixer 3, which multiples the IF signal fed in at input terminal 1 by the constant amplitude IF signal, as provided by amplitude limiter 2. The output of balanced mixer 3 is a sum signal (L+R) of the left and right stereo channel signals and, as is known, amplitude limiter 2 and mixer 3 arranged in this configuration constitute an envelope detector.

A phase-locked-loop (PLL) 4 is provided that includes phase comparator 5, low-pass filter 6, and voltage-controlled oscillator (VCO) 7, arranged in a loop configuration. In PLL circuit 4, the output from amplitude limiter 2 and the output from voltage-controlled oscillator 7 are compared in phase with each other in phase comparator 5. The phase comparison error component produced from phase comparator 5 is converted to a DC voltage by low-pass filter 6 and fed to voltage-controlled oscillator 7, that is, the output frequency of oscillator 7 is adjusted in response to the error component in order to provide a non-modulation carrier wave, sin $w_c t$, which is an orthogonal component. Low-pass filter 6 is provided with a time-constant circuit *6a*, which is comprised of a capacitor and a resistor, having values chosen so that the time constant of the low-pass filter 6 will be such to allow phase-locked-loop circuit 4 to have a bandwidth or frequency-band region as narrow as possible in this example, approximately 70 Hz.

The intermediate-frequency signal fed in at input terminal 1 is also divided by a predetermined coefficient in divider 8, and the sum signal (L+R) developed at the output of balanced mixer 3 is utilized to derive this dividing coefficient. More particularly, the sum signal (L+R) is voltage divided by resistors 9 and 10 and then fed as a control signal to divider 8. When detecting the pilot signal included in AM stereo signals broadcast using the ISB format, it is been found that the voltage dividing ratio of the voltage dividers 9 and 10 should be set at 0.5 for optmium performance. A DC bias voltage of positive one volt is provided to divider 8 along with the voltage-divider voltage by DC voltage source 11.

The output signal of phase-locked-loop 4 is taken from the output of voltage-controlled oscillator 7, and this signal plus the output signal from the IF signal divider 8 are fed to balanced mixer 12, which operates to multiply the divider 8 output signal by the phase-locked-loop circuit output signal, which are orthogonal to each other, and thereby provides a stereo difference signal (L−R). This arrangement of the phase-locked-loop circuit 4 and mixer 12 comprise the well-known configuration commonly referred to as a phase-locked-loop synchronous detector. The stereo sum signal (L+R) output from balanced mixer 3 is fed to phase-shift network 13 and, similarly, the stereo difference signal (L−R) from balanced mixer 12 is fed to phase-shift network 14. These phase-shift networks 13, 14 are necessary when detecting AM stereo signals broadcast according to the ISD system. When detecting AM stereo signals broadcast under all other AM stereo formats, these phase shift circuits 13, 14, must be removed from the signal path, and ganged switches 15, 16 are used together to remove the phase-shift networks 13, 14, from the signal path. More specifically, when receiving AM stereo signals broadcast by other than the ISB format, movable contacts of switches 15 and 16 are connected to contacts a which are connected directly to the output terminals of balanced mixers 3 and 12, respectively, while when receiving AM stereo signals broadcast according to the ISB format, movable contacts of switches 15 and 16 are connected to contacts b, which are connected to the output terminals of phase-shift networks 13 and 14, respectively. Switching matrix 17 is connected to the outputs of switches 15 and 16 and operates to switch the stereo sum signal (L+R) and the difference signal (L−R) so as to derive a left channel stereo signal L and a right channel stereo signal R, fed to output terminals 18 and 19, respectively.

A separate phase detector that is individually tailored in regard to each of the various formats of AM stereo signals is connected to the output of the phase comparator 5, which is the demodulated pilot signal regardless of the signals being received. More specifically, phase-detecting circuit 20 is intended specifically for the VCPM system, phase-detecting circuit 30 is intended specifically for the AM−PM system, phase-detecting circuit 40 is for the C−QUAM system, and phase detecting circuit 50 is intended specifically for the ISB system. Phase-detecting circuits 20, 30, 40, and 50 are substantially identical in construction and only phase-detecting circuit 20 intended specifically for the VCPM system is shown in detail. Phase-detecting circuit 20 includes level-correcting circuit 21, which receives the respective demodulated pilot signals from phase comparator 5, which forms a part of PLL 4. The demodulated pilot signals also contain interfering components and, thus, level corrector 21 corrects the voltage level differences among the pilot signals, regardless of which system such signals relate to. The level-corrected signal is fed to phase comparator 22, wherein it is compared in phase with the output from counter circuit 90, which will be described in detail hereinbelow, and a second phase comparator 23 is provided that compares in phase the level-corrected output signal with another output of counter circuit 90, which has a predetermined phase difference, for example, 90°, relative to the former output signal supplied from counter 90 that was fed to the first phase comparator 22. A level comparator 25 receives the output signal from the second phase comparator 23 and compares it with a reference level from a reference voltage source 24.

The output signals from phase-detecting circuits 20, 30, 40, and 50 are supplied through output terminals 20*a*, 30*a*, 40*a*, and 50*a*, respectively, to adder circuit 60 that produces summed output signals fed to a low-pass filter 70, wherein the summed output signals are substantially converted to DC signal levels and supplied to a voltage-controlled oscillator 80 (VCO), as the control voltage thereof. The oscillation frequency of VCO 80 is selected so that it is an integral multiple common to the frequencies of the pilot signals (see the table above) of the above described four different AM stereo systems. In this embodiment the frequency of oscillator 80 is chosen as 3300 HZ. The thus controlled output signal frequency of voltage-controlled oscillator 80 is fed to the input of counter circuit 90, which may be of the so-called Johnson kind, that generates pairs of output signals having predetermined mutual phase differences, for example, 90°, based upon the number of systems which it is to drive. For example, if there are four systems being driven by counter 90 the phase difference is 90°, whereas if there are six systems connected to counter 90, the phase difference between the two signals making up the respective six pairs of output signals would be 60°.

Counter 90 has a plurality of output terminals $b_1$, $b_2$, $b_3$, and $b_4$, and $c_1$, $c_2$, $c_3$, and $c_4$, respectively, in accordance with the number of different AM stereo systems. More specifically, at output terminal pairs $b_1$, $c_1$; $b_2$, $c_2$; $b_3$, $c_3$; and $b_4$, $c_4$ are the output signal pairs, each having a mutual phase difference of 90°. Thus, counter 90 frequency divides the output signal of oscillator 80 in response to the respective different AM stereo systems and delivers the frequency-divided, phase-difference, output signals to the respective output terminals. For example, in the case of the VCPM system, a pair of output signals, each having a frequency of 55 Hz are present at output terminals $b_1$ and $c_1$ of counter 90; in the case of the AM—PM system a pair of output signals each having a frequency of 5 Hz are present at output terminals $b_2$ and $c_2$; in the case of the C—QUAM system a pair of output signals, each having a frequency of 25 Hz are present at the output terminals $b_3$ and $c_3$; and in the case of the ISB system a pair of output signals each having a frequency of 15 Hz appear at output terminals $b_4$ and $c_4$ of counter 90. The output signal of counter 90 at output terminal $b_1$ is fed to input terminal 20*b* of phase detector 20 and to an input of phase comparator 22, wherein it is compared in phase with the output signal from level-correcting circuit 21. The output signal at output terminal $b_2$ of counter 90 is fed through input terminal 30*b* of phase detector 30 to the respective phase comparator thereof (not shown), which corresponds to phase comparator 22, thereby to carry out the same phase comparison as described in relation to phase comparator 22. Similarly, output signals from counter 90 at output terminals $b_3$ and $b_4$ are supplied through input terminals 40*b* and 50*b*, respectively, of the phase detecting circuits 40 and 50 to the respective internal phase comparators (not shown), each corresponding functionally to phase comparator 22, whereby a similar phase comparison is carried out. Thus, phase comparator 22, and the corresponding phase comparators in the phase detectors 30, 40, and 50, operate in conjunction with voltage-controlled oscillator 80 and low-pass filter 70 to form a phase-locked-loop circuit.

The output signal from output terminal $c_1$ of counter 90 is fed through input terminal 20*c* of phase detector 20 to an input of phase comparator 23, wherein it is phase compared with the output signal from level corrector 21. Similarly, output signals from output terminals $c_2$, $c_3$, and $C_4$ of counter 90 are supplied, respectively, through input terminals 30*c*, 40*c*, and 50*c* of their respective phase detectors 30, 40, and 50 to the internally arranged phase comparators (not shown), with each such phase comparator corresponding to phase comparator 23 of phase detector 20. In this fashion, output signals from counter 90 are phase compared with the output signal from each respective level-correcting circuit corresponding to level-correcting circuit 21 of phase detector 20. Accordingly, phase detector 23, and the other corresponding phase comparators, are used to detect the level of the respective pilot signals. Thus, when the output signal from phase detector 22 that performs the phase locking is zero, the signals are locked and in phase and, conversely the output from phase comparator 23 that acts to detect the pilot signal will be a maximum. Thus, for example, in phase detector 20, the output from phase comparator 23 is compared with the reference voltage from reference voltage circuit 24 in level comparator 25, and when the level of the output is larger than the reference value 24, level comparator 25 produces an output signal fed through output terminal 20*d* that is the detected pilot signal.

More particularly, level comparator 25 operates to integrate the output signal from phase comparator 23 so that if the value thereof is larger than the reference value, as set by bias voltage 24, the output signal is delivered from the level comparator 25 as the pilot signal. If the input signal to the system is a signal other than the desired pilot signal, the integrated level of the output from phase comparator 23 will be lowered and will be smaller than the reference level, so that the level comparator 25 will produce no output and no pilot signal will be produced. A similar operation is carried out in the other phase detectors 30, 40, and 50 provided for the AM stereo signals broadcast using the other formats. It can be a relatively simple matter to discriminate which of the respective stereo signals is being received by providing an indicator (not shown) responsive to the pilot signals developed by at output terminals 20*d*, 30*d*, 40*d*, and 50*d*, of the respective phase detectors 20, 30, 40, and 50.

The output signal from phase detector 50 is also used to control the action of switches 15 and 16, specifically, in receiving signals broadcast by the systems other than the ISB system, the movable contacts of switches 15 and 16 are connected to contacts a, while in the ISB system once the pilot signal is obtained the movable contact of switches 15 and 16 are changed over in position to be connected to the other fixed contacts b by means of the output signal 50*b*. This switching action in response to the detected ISB pilot signals acts to insert the necessary phase shifting circuit networks 13 and 14 into the signal paths.

Figure 2:
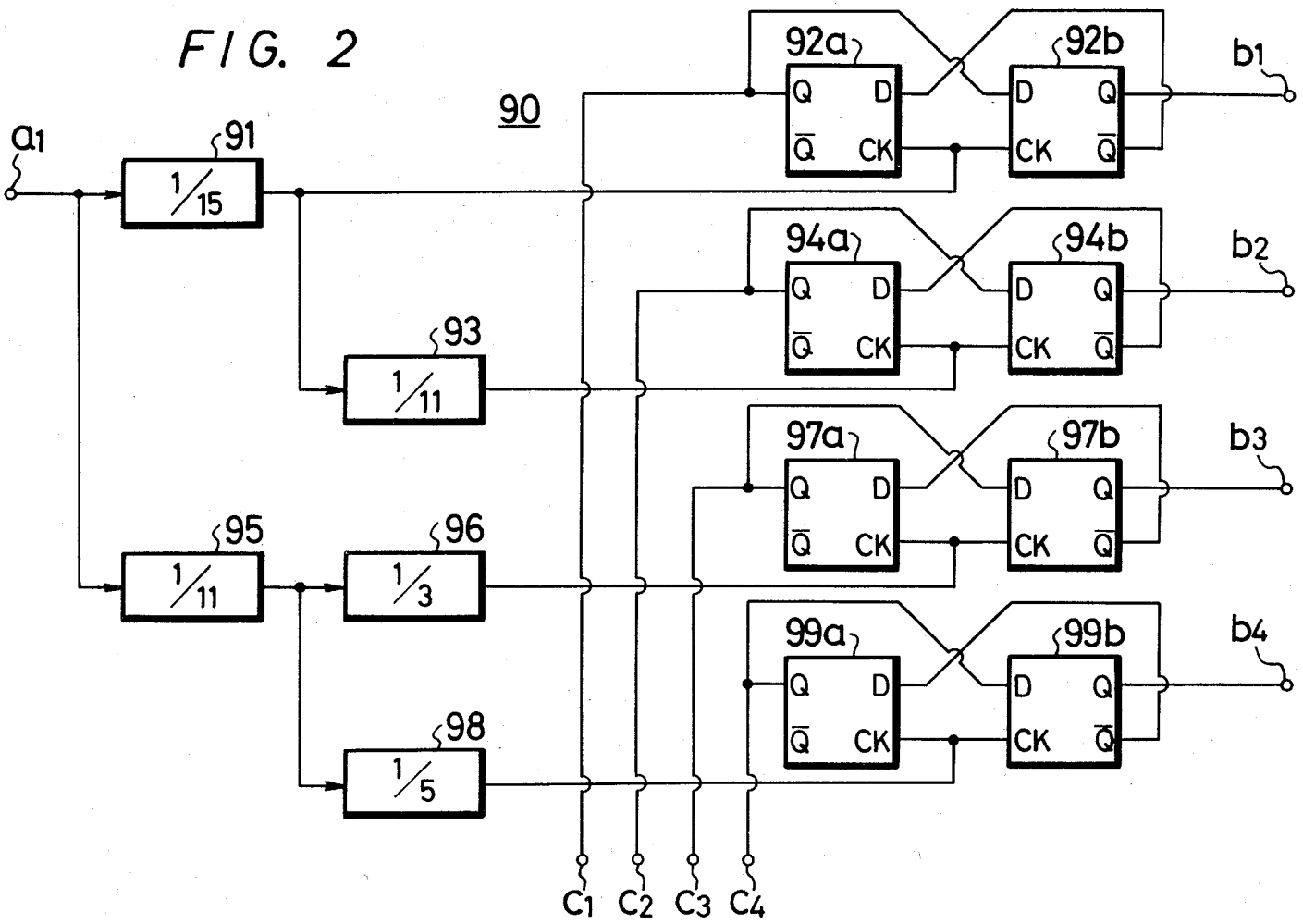
FIG. 2 is a schematic block diagram showing the counter unit of FIG. 1 in more detail.

FIG. 2 shows one embodiment of counter 90 of FIG. 1. Generally, counter 90 comprises frequency dividers to divide down the frequency of the output signals from voltage-controlled oscillator 80 and then utilizes appropriate pairs of flip-flops to frequency divide the signal even further, and to provide the two signals that are 90° out of phase with each other but which have the same frequency. More specifically, in the case of the VCPM AM stereo system, the output frequency from voltage-controlled oscillator 80 will be 3300 Hz and this signal is fed into input terminal $a_1$ of counter 90. This 3300 Hz signal is frequency divided by 1/15 in frequency divider 91 and is then further frequency divided by $\frac{1}{4}$ using a pair of flip-flop circuits 92*a* and 92*b*. The result of this is an output signal having a frequency of 55 Hz derived from output Q of flip-flop circuit 92*b* and made available to the output terminal $b_1$, while a complementary output signal having a phase difference of 90° relative to the output at terminal $b_1$ is derived from output Q of flip-flop circuit 92*a* and is made available at output terminal $c_1$ of counter 90.

To detect the pilot signal of received AM stereo signals that are in the AM−PM mode, the output frequency from frequency divider 91 is further divided by 1/11 by frequency divider 93 and then frequency divided by $\frac{1}{4}$ by another pair of flip-flop circuits 94*a* and 94*b*. Thus, an output signal having a frequency of 5 Hz will be available at output terminal $b_2$ from output Q of flip-flop 94*b* and, conversely, the output signal at output Q of flip flop 94*a* will have a frequency of 5 Hz but with a phase difference of 90° relative to the output at output terminal $b_2$. In the case of receiving AM stereo signals modulated using the C−QUAM system the signal produced by voltage-controlled oscillator 80 fed into input terminal $a_1$ will be frequency divided by frequency divider 95 by a factor of 1/11 and then further frequency divided by $\frac{1}{3}$ by frequency divider 96. The signal thus frequency divided will be further frequency divided by $\frac{1}{4}$ by a third pair of flip-flop circuits 97*a* and 97*b*. Accordingly, an output signal of 25 Hz is available at output Q of flip-flop 97*b* and is fed to output terminal $b_3$ of counter 90, and an output signal also of 25 Hz but having a phase difference of 90° relative to the output of output terminal $b_3$ is derived from output terminal Q of flip-flop circuit 97*a* and fed to output terminal $c_3$. When the AM stereo signals being received have been encoded according to the ISB system, the output signal of frequency divider 95 is divided further by a factor of 1/5 in frequency divider 98 and is then subsequently frequency divided by $\frac{1}{4}$ by the fourth pair of flip-flop circuits 99*a* and 99*b*. Thus, an output signal of 15 Hz is available at output terminal Q of flip-flop circuit 99*b* and is made available to output terminal $b_4$ of counter 90, while an output signal of 15 Hz having a phase difference of 90° relative to the output signal and output terminal $b_4$ is derived from output Q of flip-flop 99*a* and made available to output terminal $c_4$.

In operation of the above circuit, and referring back to FIG. 1, the intermediate frequency signal from the receiver is fed through input terminal 1 directly to one input of balanced mixer 3 and is also fed through amplitude limiter 2 to the other input of mixer 3, as representing a signal of constant amplitude. The result of this is that mixer 3 provides as an output signal a stereo sum signal (L+R) of the received AM stereo signal. The IF signal at terminal 1 is also fed to the input of divider 8, in which it is divided by a predetermined dividing coefficient, derived from the stereo sum signal and a voltage dividing network, and fed to one input of balanced mixer 12. The other input of balanced mixer 12 is the signal derived from phase-locked-loop (PLL) 4, that is, the signal sin $w_c t$, which is the orthogonal component obtained in PLL circuit 4, is fed to the other input of balanced mixer 12, thereby producing an output signal that is the difference signal (L−R) of the received stereo left and right channel signals. When the AM stereo signals that are received were broadcast according to either the VCPM system, the AM−PM system, or the C−QUAM system, the stereo sum signal (L+R) that is developed at the output of balanced mixer 3 is supplied directly through contact a of switch 15 to switching matrix 17 and, similarly, the stereo difference signal (L−R) developed at the output of balanced mixer 12 is fed directly through terminal a of switch 16 to switching matrix 17. Switching matrix 17 operates to separate and combine the stereo sum difference signals so that at output terminals 18 and 19 are made available the left-channel stereo signal L and the right-channel stereo signal R, respectively.

On the other hand, when the AM stereo signals are broadcast according to the ISB system the stereo sum signal and stereo difference signal are phase shifted by minus 45° and plus 45°, respectively, so that the stereo sum signal and the stereo difference signal obtained at the outputs of mixers 3 and 12 must be phase shifted in a corresponding fashion. The outputs of phase-shif networks 13 and 14 are connected through contacts b of switches 15 and 16, respectively, to matrix circuit 17 so that the phase-shifted stereo left-channel signal (L) and the phase-shifted stereo right-channel signal (R) can be produced at output terminals 18 and 19, respectively.

Thus, when the AM stereo signals are received it is necessary to have switches 15 and 16 set to the appropriate contacts, that is, switch contacts are in position a for all various AM stereo systems except the ISB system, in which case the movable contacts of switches 15 and 16 are changed to contacts b. The present invention provides such switching as follows, when the AM stereo signals transmitted according to the VCPM system are received, the compared error output from phase comparator 5 of the phase-locked-loop 4 is corrected by level-correcting circuit 21, which is located in the phase detector 20, and this level-corrected signal is fed to phase comparator 22 and also to phase comparator 23. The level-corrected signal from level corrector 21 is then compared in phase with two signals having a frequency of 55 Hz but with a phase difference of 90° therebetween, as derived from the output frequency of oscillator 80 by means of the counter 90. The phase-comparison output signal from phase comparator 22 is then fed through adder 60 to low-pass filter 70 where it is essentially converted to a DC signal and fed to oscillator 80 where it closes the control loop and controls the frequency of the VCO output signal. Thus, when the desired pilot signal, in this case the pilot signal of the VCPM system, is contained in the input signal to phase comparator 22 the output from phase comparator 22 becomes zero and the phase-lock-loop, which includes the oscillator 80 and counter 90 becomes locked. The corresponding complementary output signal from counter 90 is fed to phase comparator 23, and this output signal $c_1$ has a 90° phase difference relative to the signal $b_1$ that was fed to phase comparator 22 from counter 90. This means that the output signal from phase comparator 23 will be at its maximum, and this maximum value signal is compared with the reference value from the reference voltage source 24 in level comparator 25, which then produces the appropriate output signal that is fed to output terminal 20*d* as the pilot signal. This pilot signal may be used in an indicator (not shown) to indicate that the AM stereo broadcast is being received and demodulated according to the VCPM system.

Similar operations are carried out in relation to the AM-PM system, the C-QUAM and the ISB system, except that the frequency of the signals supplied to the input terminals of the phase detectors 30, 40, and 50, respectively, from counter 90 are all different. Thus, for example, at output terminals 30*d*, 40*d*, and 50*d*, of phase detectors circuits 30, 40, and 50, respectively, the pilot signals will appear when the input signals to those respective phase detectors contain the corresponding pilot frequency components. These pilot signals can then also be fed to the appropriate indicators (not shown).

Not only will the output signal from phase detector 50 be utilized to operate an indicator, but it is also fed to switches 15 and 16, so that the movable contacts of those switches are connected to contacts b to place shifters 13 and 14 in the signal path. Switches 15 and 16 are normally switched to the a contacts and, thus, when no signal is present at output terminal 50*d* of phase detector 50, indicating that the signals being received are not broadcast according to the ISB system, switches 15 and 16 remain at terminals a.

Figure 3:
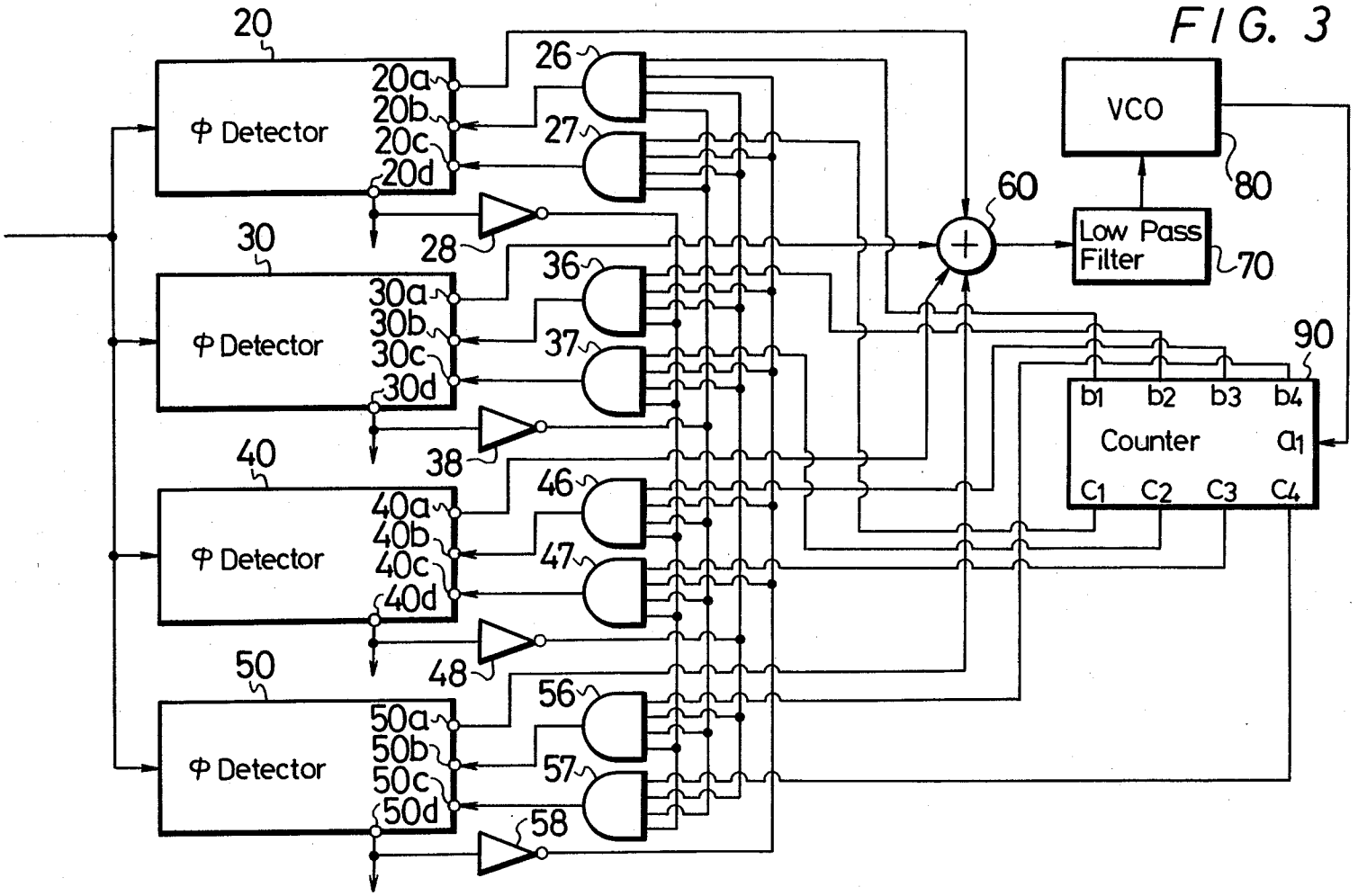
FIG. 3 is a schematic block diagram showing another embodiment of the pilot signal detecting circuit for AM stereo detecting the pilot signal in signals broadcast by one of several different systems, according to the present invention.

FIG. 3 shows another embodiment of the pilot signal detecting circuit for use in detecting the pilot signal of AM stereo signals transmitted according to any of the currently known formats. In this embodiment, once one of the pilot signals has been detected, the phase detector circuits for all of the other systems are inhibited from operation as long as the initially detected pilot signal is present. This is contrary to the system of FIG. 1, in which even though a pilot signal has been received, the other phase detectors continue to receive the pairs of phase-difference signals from counter 90 trying to detect their respective pilot signal. To eliminate this continuing signal processing, which utilizes power that might be provided by a battery, the embodiment of FIG. 3 provides gate circuits, which comprise AND 26 and 27 arranged between the input terminals 20*b*, 20*c* of phase detector circuit 20 and output terminals $b_1$, $c_1$ of counter 90. Similarly, between input terminals 30*b*, 30*c* of phase detector 30 and output terminals $b_2$, $c_2$ of counter 90 are connected, respectively, AND gates 36, 37; between input terminals 40*b*, 40*c* of phase detector 40 and output terminals $b_3$, $c_3$ of counter 90 are connected, respectively, AND gates 46, 47; and between input terminals 50*b*, 50*c* of phase detector 50 and output terminals $b_4$, $c_4$ of counter 90 are connected, respectively, AND gates 56, 57. Invertor circuits 28, 38, 48, and 58, are connected respectively, to output terminals 20*d*, 30*d*, 40*d*, and 50*d* of phase detector circuits 20, 30, 40, and 50, respectively, whereby upon receiving a broadcast of one of the AM stereo systems, a pilot signal will be detected and one of the outputs 20*d*, 30*d*, 40*d* or 50*d*, will go high and the action of corresponding inventor will place a zero at all of the AND gates except the two AND gates the place detectory for that particular pilot signal. More particularly, the output of invertor 28 is connected to an input of AND gates 36 and 37, 46 and 47, 56 and 57; the output of invertor 38 is connected to an input of AND gates 26 and 27, 46 and 47, 56 and 57; the output of invertor 48 is connected an to input of AND gates 26 and 27, 36 and 37, 56 and 57; and the output of invertor 58 is connected to an input of AND gates 26 and 27, 36 and 37, 46 and 47. Accordingly, if for example a stereo broadcast according to the VCPM system is received and the appropriate pilot signal is produced at terminal 20*d* of phase detector 20 this pilot signal will be inverted by inverter 28 and a zero output level fed to an input of AND circuits 36 and 37, 46 and 47, 56 and 57 of the phase detectors corresponding to the other systems, thereby causing these AND gates to be opened or blocked and prevent any phase comparison of the other signals from counter 90. When a broadcast of one of the other systems is received, a similar operation will take place, thereby stopping the operation all phase detectors except the one corresponding to the signal being received.

In this embodiment, the logical product of the pilot signal detected outputs of all other systems and the outputs from the counter 90 is used as the compared input to the phase comparators and, once a desired pilot signal has been detected, and so long as that detected pilot signal does not disappear, the other phase-detector circuits relative to all other AM stereo systems will not be operational. Thus, these phase detectors relative to the other AM stereo systems can be prevented from being triggered by interference or the like, and the reliability of the receiver and stability relative to the reception of a single AM stereo system is enhanced.

While the above embodiments have been described in relation to an AM stereo system, the present invention need not be so limited and can be applied to other situations in which a plurality of information signals are present and control signals contained within the respective information signals must be individually detected. Similarly, while the above embodiments relate to four different AM stereo systems made up of the VCPM system, the AM−PM system, the C−QUAM, system and the ISB system, the present invention can also be applied to other combinations AM stereo systems, for example, the AM−FM system, in which a pilot frequency of 10 Hz and a level of 20% is employed.

Although illustrative embodiments of the present invention have been described in detail above with reference to the accompanying drawing, it is to be understood that the invention is not limited to those precise embodiments, and that various changes and modifications can be effected therein by one skilled in the art without departing from the spirit and scope of the invention, as defined by the appended claims.

What is claimed is:

1. Apparatus for detecting and identifying a pilot signal contained in a received AM stereo signal modulated according to an unidentified one of a plurality of different AM stereo modulation systems, comprising:

AM stereo demodulator means connected to said received AM stereo signal for producing a demodulated AM stereo signal therefrom;

signal extracting means connected to said AM stereo demodulator means for extracting from said demodulated AM stereo signal a signal containing said pilot signal;

means for generating a plurality of reference pilot signals corresponding to respective ones of said plurality of different AM stereo modulation systems; and comparing means for comparing each of said plurality of reference pilot signals with said signal containing said pilot from said signal extracting means and producing an output signal upon a coincidence therebetween, said output signal identifying the one of the plurality of different AM stereo modulation systems employed in said received signal.

2. Apparatus for detecting and identifying a pilot signal according to claim 1, in which said means for generating a corresponding plurality of reference pilot signals comprises a controllable frequency oscillator producing an output signal having a frequency that is a common multiple of the frequency of the pilot signals of all of said plurality of different AM stereo modulation systems, and a frequency divider for frequency dividing said output signal from said controllable frequency oscillator, thereby generating said plurality of reference pilot signals.

3. Apparatus for detecting and identifying a pilot signal according to claim 2, in which said plurality of reference pilot signals produced by said frequency divider comprises a pair of reference pilot signals for each of said plurality of different AM stereo modulation systems, and in which each pair of reference pilot signals has the same mutual phase-difference.

4. Apparatus for detecting and identifying a pilot signal according to claim 2, in which said comparing means comprises level-corrector means receiving said signal containing said pilot signal and phase-comparator means responsive to an output from said level-corrector means and to said reference pilot signals, and low-pass filter means, an output of said phase-comparator means being fed through said low-pass filter means to said controllable frequency oscillator to control the oscillatory frequency thereof at said common multiple of said plurality of different pilot signal frequencies.

5. Apparatus for detecting and identifying a pilot signal according to claim 4, in which said comparing means further comprises second phase-comparator means responsive to said output from said level-corrector means and to said reference pilot signals, and a level comparator having a predetermined threshold level, an output of said second phase comparator means being fed to said level comparator and upon exceeding said threshold value said level comparator producing said output signal identifying the AM stereo modulation system employed in said received signal.

6. Apparatus for detecting and identifying a pilot signal according to claim 2, in which said comparing means comprises a plurality of phase detector circuits each receiving said signal containing said pilot signal and corresponding ones of said plurality of reference pilot signals, each of said plurality of phase detector circuits providing a pilot signal identification output signal upon coincidence and an oscillator control signal fed back to said controllable frequency oscillator for controlling the frequency thereof.

7. Apparatus for detecting and identifying a pilot signal according to claim 6, further comprising logic means connected to said plurality of phase detector circuits, whereby upon one of said phase detector circuits detecting a pilot signal and producing a pilot signal identification output signal said logic means inhibits the remaining ones of said phase detector circuits from receiving said plurality of reference pilot signals.

8. Apparatus for detecting and identifying a pilot signal according to claim 7, in which said logic means comprises a plurality of AND gates arranged at the inputs of said phase detector circuits, and a plurality of invertor means, one of said invertor means being connected to the output of a corresponding phase detector means and to an input of each of said plurality of AND gates, so that when said phase detector means produces a pilot signal identification output signal a zero signal level is present at the input of said plurality of AND gates connected to said phase detector means not producing a pilot signal identification output signal.

9. Apparatus for detecting and identifying a pilot signal according to claim 2, in which said AM stereo demodulator comprises a single demodulator circuit including a phase-locked-loop, a synchronous detector producing a stereo difference signal, an envelope detector producing a stereo sum signal, and a switching matrix means connected to said stereo difference signal and said stereo sum signal for producing a respective stereo left channel signal and a stereo right channel signal therefrom.

10. Apparatus for detecting and identifying a pilot signal according to claim 9, in which one of said plurality of different AM stereo modulation systems is the independent sideband system and in which said AM stereo demodulator further comprises a phase-shifting network for shifting said stereo sum signal and said stereo difference signal in phase, and switch means for switchably connecting said phase-shifted stereo sum and stereo difference signals to said switching matrix network in response to the detection of an independent sideband pilot signal.

11. Apparatus for producing a signal identifying a received AM stereo signal modulated by an unidentified one of a plurality of different AM stereo modulation systems, comprising:

AM stereo demodulator means connected to said received AM stereo signal for demodulating said AM stereo signal into a left channel stereo signal and a right channel stereo signal;

pilot signal extracting means connected to said AM stereo demodulator means for extracting from said received AM stereo signal a signal containing said pilot signal;

reference pilot signal generating means for producing a plurality of reference pilot signals corresponding to respective ones said plurality of different AM stereo modulation systems; and a plurality of detector means each connected to receive a corresponding one of said plurality of reference pilot signals and each connected to receive said signal containing said pilot signal for comparing corresponding ones of said plurality of reference pilot signals with said signal containing said pilot signal, one of said plurality of detector means producing an output identifying signal upon a coincidence therebetween, said output identifying signal thereby identifying the one of said plurality of different AM stereo modulation systems embodied in said received AM stereo signal.

12. Apparatus according to claim 11, further comprising logic means connected to said plurality of detector means and said plurality of reference pilot signals, whereby upon one of said plurality of detector means producing said output identifying signal said logic means inhibits the remaining plurality of detector means from receiving said corresponding ones of said reference pilot signals.

13. Apparatus according to claim 12, in which said logic means comprises a plurality of AND gates arranged at the inputs of said plurality of detector means and connected to receive said plurality of reference pilot signals, and a plurality of invertor means, one connected to the output of each of said detector means and to an input of said plurality of AND gates, whereby when said plurality of detector means produces an output signal identifying a pilot signal and a low-level signal is present at an input of corresponding ones of said plurality of AND gates connected to corresponding inputs of all other of said plurality of detector means.

14. Apparatus according to claim 11, in which said AM stereo demodulator means comprises a single demodulator formed of a phase-locked-loop and an envelope detector producing a stereo sum signal and a synchronous detector producing a stereo difference signal, and a switching matrix receiving said stereo sum signal and said stereo difference signal for producing a respective stereo left channel signal and a stereo right channel signal therefrom.

15. Apparatus according to claim 14, in which one of said different AM stereo modulation systems is an independent sideband system and in which said AM stereo demodulator further comprises phase-shifting network receiving said stereo sum signal and said stereo difference signal for imparting respective phase shifts thereto, and switch means for switchably connecting said phase-shifted stereo sum signal and stereo difference signal to said switching matrix network in response to the detection of an independent sideband pilot signal by one of said plurality of detector means.

16. Apparatus according to claim 11, in which said means for generating said plurality of reference pilot signals comprises a controllable frequency oscillator producing an output signal having a frequency that is a common multiple of the pilot signal frequency of all of said plurality of different AM stereo modulation systems, and a frequency divider for frequency dividing said output from said controllable frequency oscillator and generating said plurality of reference signals therefrom.

17. Apparatus according to claim 16, in which said plurality of reference pilot signals produced by said frequency divider comprises a pair of pilot signals for each of said plurality of detector means and in which each of said pair of reference pilot signals has the same mutual phase difference therebetween.

18. Apparatus according to claim 11, in which said comparing means includes level-comparator means receiving said signal containing said pilot signal and phase-comparator means responsive to an output from said level-corrector means and said reference pilot signal, and low-pass filter means, an output of said phase-comparator means being fed through said low-pass filter means to control the oscillatory frequency of said controllable frequency oscillator.

19. Apparatus according to claim 18, in which said comparing means further comprises second phase-comparator means responsive to said output from said level-corrector means and said corresponding one of said plurality of reference pilot signals, level-comparator means having a predetermined threshold level, an output of said second phase-comparator means being fed to said level-comparator means and, upon exceeding said predetermined threshold level, said level comparator means produces said output identifying signal.

* * * * *